US005398909A

United States Patent [19]

Sandwith

[11] Patent Number: 5,398,909

[45] Date of Patent: Mar. 21, 1995

[54] CHANNEL BEAM AND T-BOLT SYSTEM

[75] Inventor: Stanley R. Sandwith, Lions Bay, Canada

[73] Assignee: Channel Form Systems Inc., Lions Bay, Canada

[21] Appl. No.: 119,562

[22] Filed: Sep. 13, 1993

[51] Int. Cl.[6] ..... E04G 17/00

[52] U.S. Cl. ..... 249/207; 52/731.2; 52/731.7; 52/732.1; 249/213; 249/219.1; 249/219.2

[58] Field of Search ..... 249/219.1, 219.2, 207, 249/189, 192, 191, 190, 213, 47; 52/731.1, 731.7, 727, 729, 732.1

[56] References Cited

U.S. PATENT DOCUMENTS

| | | | |
|---|---|---|---|
| 805,883 | 11/1905 | Russell . | |
| 2,021,210 | 11/1935 | Thorn . | |
| 2,511,829 | 6/1950 | Arrighini et al. . | |
| 2,614,311 | 10/1952 | Shook . | |
| 3,416,280 | 12/1968 | Young | 52/732.1 |
| 3,531,902 | 10/1970 | Costa | 52/732.1 |
| 3,595,516 | 7/1971 | Rice . | |
| 4,034,957 | 7/1977 | Cody | 249/219.1 |
| 4,144,690 | 3/1979 | Avery | 52/731.2 |
| 4,254,932 | 3/1981 | Durbin | 249/219.2 |
| 4,473,209 | 9/1984 | Gallis et al. | 249/219.1 |
| 4,880,204 | 11/1989 | Steele | 249/219.2 |
| 4,917,346 | 4/1990 | Mathis . | |
| 5,219,473 | 6/1993 | Sandwith . | |

FOREIGN PATENT DOCUMENTS

| | | | |
|---|---|---|---|
| 1276315 | 8/1968 | Germany | 52/731.2 |
| 2319190 | 4/1973 | Germany . | |
| 2438226 | 3/1975 | Germany | 52/731.2 |

*Primary Examiner*—Khanh Nguyen
*Attorney, Agent, or Firm*—Oyen Wiggs Green & Mutala

[57] ABSTRACT

This invention pertains to a novel component for constructing concrete forms. More particularly, this invention pertains to a concrete form system component comprising interlocking novel channel form beams and T-bolt connections. A T-bolt channel form beam including: (a) an elongated hollow channel member; (b) an elongated T-bolt received first cavity formed in a top region of the channel member, said elongated cavity having therein an elongated opening which is parallel with the elongated channel member and exposes the interior of the first elongated cavity to the exterior; (c) an elongated second cavity formed in the interior of the elongated channel member, adjacent to and parallel with the elongated first cavity; (d) an elongated third cavity, adjacent to and parallel with the second cavity and first cavity, and separated in part from the second cavity by an elongated membrane; and (e) an elongated T-bolt receiving fourth cavity, reversed in orientation with the first cavity, and adjacent to and parallel with the third cavity, the fourth cavity having therein an elongated opening which is parallel with the elongated channel member and exposes the interior of the first elongated cavity to the exterior.

17 Claims, 6 Drawing Sheets

CHANNEL BEAM AND T-BOLT SYSTEM

FIELD OF THE INVENTION

This invention pertains to a novel component for constructing concrete forms. More particularly, this invention pertains to a concrete form system component comprising interlocking novel channel form beams and T-bolt connections.

BACKGROUND OF THE INVENTION

According to current construction practice, concrete structures such as foundation grade beams, concrete walls, columns, suspended and spandrel beams and concrete float structures, are cast in place in a conventional timber or steel formwork system. Precasting off-site is another common concrete structure manufacturing technique.

A conventional foundation grade beam or a concrete wall may be used to support, for example, the exterior wall and upper structure of a building. A grade beam is a cast in place concrete structure reinforced with mild steel rods. A standard type grade beam may have a standard cross-section of 8 in. width and 24 in. depth. The span length between intermediate supports such as footings or piles is variable but is usually anywhere from 12 to 36 ft. Concrete foundation walls, and the like, are usually higher and longer.

A grade beam or concrete wall is typically cast in place in a pre-formed or constructed on site elaborate timber or steel formwork system which is time consuming and labour intensive to construct. A conventional timber formwork system can only be used six or seven times before it deteriorates to the point where it must be discarded. New timber formwork is then erected and used. Steel formwork does not deteriorate with repeated use, but is expensive, heavy and may be labour intensive to install. The concrete grade beam or concrete wall is reinforced throughout its length and height with horizontally placed steel rods and vertical stirrups.

The grade beam or wall sections are cast in a conventional formwork system of timber and/or steel construction which are assembled and erected in place, aligned, plumbed, and adequately braced prior to placement of reinforcing steel and concrete within the interior of the formwork. After the concrete grade beam or wall has been poured in place, the formwork is then dismantled after the concrete has reached an adequate set. The formwork is then positioned and reassembled to continue the previously poured in place concrete beam or wall section, and prepared for the next concrete pour.

The conventional way to construct or assemble a standard timber or steel formwork system, and pour a standard steel reinforced rectangular cross-section grade beam or wall has a number of disadvantages: (1) the assembly and dismantling of the formwork is labour and time intensive; (2) the reuse potential of the conventional timber formwork materials is limited; (3) the formwork does not efficiently adapt to heat or steam cure methods; and (4) the rectangular cross-section of a conventional grade beam has always been the easiest shape to form by conventional methods, but it is structurally inefficient and uses more concrete than is necessary to achieve design strength. (At least 25% more concrete than necessary is required in a standard 8" by 24" cross-section grade beam). This degree of design inefficiency increases in direct proportion with any increase in the depth of the beam. This degree of inefficiency can easily exceed 50% in many practical applications.

In my U.S. Pat. No. 5,219,473, issued Jun. 15, 1993, I disclose and claim an invention which pertains to a novel adjustable formwork system which can be used in the manufacture of a wide range of structurally efficient cross-sectional shaped concrete beams, walls, columns and structures. In one version, a cast-in-place concrete beam form can be constructed comprising at least two spatially oriented upper sleeves with an upper web located on one side of the two sleeves, and extending therebetween, at least two spatially oriented lower sleeves, with a lower web located on one side of the two sleeves, and extending therebetween, and at least two members, each member conducting telescopically the respective upper sleeve with the respective lower sleeve, the telescoping members enabling the two upper sleeves to be raised or lowered relative to the two lower sleeves. FIGS. 30 through 34 of that U.S. patent, in particular, disclose a system for constructing a form of adjustable height comprising a series of upper sleeves 70, which can be raised upon corresponding sliders 98, relative to a corresponding series of lower sleeves 72. The system conforms with standard pieces of lumber, 2×4, 2×6, 2×8, etc., and the like, that are used in commercial concrete construction. The slider 98 is normally formed of aluminum. Keeper plates 82 are secured in place with standard snap-ties 74 extending through the upper sleeve, or the lower sleeve respectively. Among other things, standard walers 96 constructed of standard 2×4 inch timber pieces are used, as illustrated in FIG. 32, for instance. Two sizes of snap-tie are required. For example, if a concrete form system is constructed of a pair of spaced apart plywood sheets, reinforced by a pair of walers on opposite sides, and a corresponding pair of strongbacks on opposite sides, the long snap-tie which holds the two sides in place must span not only the distance between the two facing plywood forms, but also must penetrate through the two walers and the two strongbacks. On the other hand, short snap-ties in such a construction need not penetrate the strongbacks but must penetrate only through the space spanned as well as a pair of plywood sheets and a pair of walers.

In one form of concrete formwork system, the membrane, such as a plywood sheet, which is used to construct one side of a form, is reinforced on the side away from the concrete side by a network of horizontal walers, which are usually wood 2×4's, and a series of vertical strongbacks, which can also be standard wood 2×4's. A matching "mirror" form is placed on the opposite side, the interior is reinforced with a network of reinforcing steel bars and the cavity between the two is then filled with concrete. The two sides can be fastened together with two lengths of form-ties, the short end-ties required for the walers and the long end-ties required for the walers and strongbacks. In an alternative form of construction, however, T-bolts can be used which fit into aluminum I-beams, which are produced by various companies such as Anthes Equipment, Toronto. The T-bolts are constructed to have a square positioning flange, which fits into mating receiving cavities in the I-beam. The T-bolts are usually constructed of steel, while the I-beams, which take the place of walers and strongbacks, are formed of extruded aluminum. The T-bolts are secured in place in the receiving flanges of the aluminum beams by rotating the T-bolts 90° from an open to a locked position. One advantage of the T-bolt system is that it eliminates the need for two lengths of snap-ties.

SUMMARY OF THE INVENTION

The invention is directed to a T-bolt channel form beam comprising: (a) an elongated hollow channel member; (b) an elongated T-bolt received first cavity formed in a top region of the channel member, said elongated cavity having therein an elongated opening which is parallel with the elongated channel member and exposes the interior of the first elongated cavity to the exterior; (c) an elongated second cavity formed in the interior of the elongated channel member, adjacent to and parallel with the elongated first cavity; (d) an elongated third cavity, adjacent to and parallel with the second cavity and first cavity, and separated in part from the second cavity by an elongated membrane; and (e) an elongated T-bolt receiving fourth cavity, reversed in orientation with the first cavity, and adjacent to and parallel with the third cavity, the fourth cavity having therein an elongated opening which is parallel with the elongated channel member and exposes the interior of the first elongated cavity to the exterior.

The channel beam can have a symmetrical configuration about the membrane separating the second and third cavities. An elongated slot can be formed in the membrane separating the second cavity from the third cavity.

The walls of the beam between the first and second cavity, and the walls of the beam between the third cavity and the fourth cavity can have angled face ridges which are elongated and parallel with the elongated cavities. The elongated openings of the first and fourth cavities can have on each side thereof respective pairs of opposing lips facing one another and constructed along respective sides of the elongated openings exposing the interiors of the first and fourth cavities.

The first cavity and the fourth cavity can be adapted to receive a T-bolt which comprises: (a) an elongated cylindrical stem; (b) a head having a generally rectangular configuration, with opposed two of the four corners of the rectangle being rounded; and (c) a ring shoulder constructed between the head and the stem, the ring shoulder being adapted to fit between the openings in either the first cavity or the fourth cavity of the channel form member.

The T-bolt head can include angled faces which abut with angled faces of the top first cavity or the bottom fourth cavity of the channel beam when the T-bolt is rotated 90° so that the ends of the rectangular flange penetrate laterally and lock into the interior of the first cavity or the fourth cavity of the channel beam.

The channel form beam may include a second channel beam which is fitted together, with the first channel beam at right angles with one another, the head of the T-bolt being positioned in a locked position in the first cavity of the first channel beam, the stem of the T-bolt extending through an opening in the elongated membrane between the second and third cavities of the second channel beam, the end of the stem of the T-bolt protruding from the second channel beam and being adapted to be fixed into position.

The invention is also directed to a T-bolt channel form beam comprising: (a) an elongated channel member; (b) an elongated top cavity formed in the top region of the channel member, said elongated cavity having therein an elongated opening which is parallel with the elongated channel member and exposes the interior of the first cavity to the exterior; (c) an elongated second cavity formed in the interior of the elongated channel member, parallel and adjacent with the elongated first cavity; (d) an elongated third cavity, parallel with and adjacent to the second cavity, and separated from the second cavity by an elongated membrane, said third cavity having an elongated opening formed therein which exposes the interior of the third cavity to the exterior, said elongated opening being positioned on the side of the third cavity opposite the membrane separating the second cavity from the third cavity; and (e) an elongated opening formed in the membrane separating the second cavity from the third cavity.

The channel form beam may include a membrane separating the first cavity from the second cavity, the membrane having angled faces at each elongated side thereof mating with respective sides of the first cavity. The first cavity can have a pair of opposing lips facing one another and constructed along respective sides of the elongated opening exposing the interior of the first cavity. The third cavity can have a pair of opposing lips facing one another and constructed along respective sides of the elongated opening exposing the interior of the third cavity.

The first cavity can be adapted to receive a T-bolt which comprises: (a) an elongated cylindrical stem; (b) a head having a generally rectangular configuration, with opposed two of the four corners of the rectangle being rounded; and (c) a ring face constructed between the head and the stem, the ring face being adapted to fit between the opposing facing lips of the top cavity of the channel member.

The T-bolt head can include angled faces which abut with the angled faces of the first cavity of the channel beam when the T-bolt is rotated 90° so that the ends of the rectangular flange penetrate laterally into the interior of the first cavity of the channel beam.

The channel form beam can include a second channel beam fitted together, with the first channel beam at right angles with one another, the head of the T-bolt being positioned in a locked position in the first cavity of the first channel beam, the stem of the T-bolt extending through a slot in the membrane of the second channel beam, the end of the stem protruding from the second channel beam, opposite the first channel beam and being adapted to be fixed into position.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
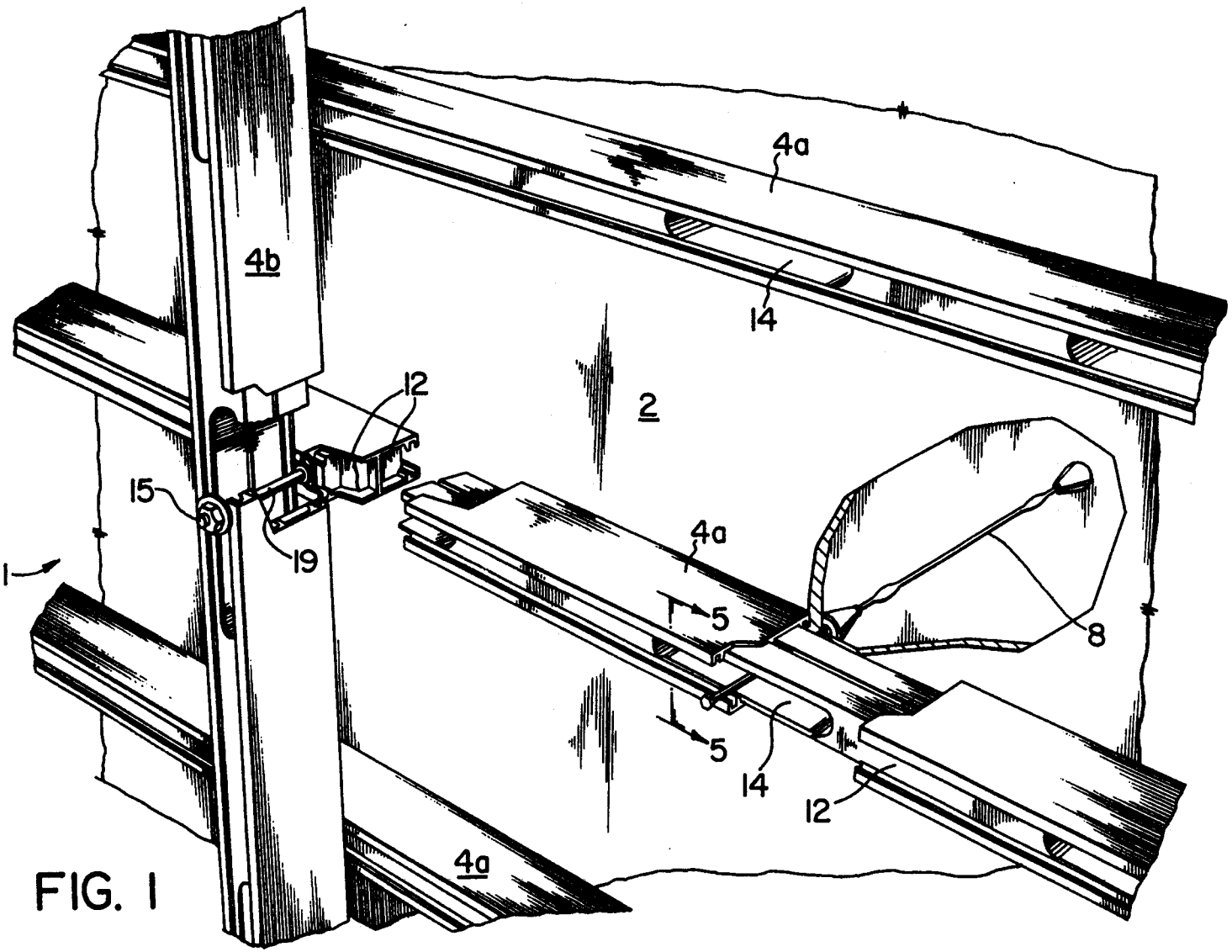
FIG. 1 illustrates an isometric view of a waler, strongback wall formwork combination according to the invention, used to construct a concrete form system.
Figure 2:
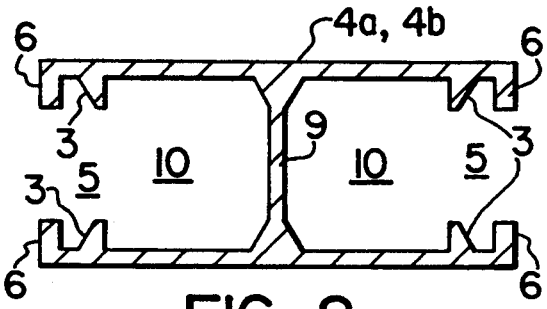
FIG. 2 illustrates an end section view of a first embodiment of an extruded aluminum beam.
Figure 3:
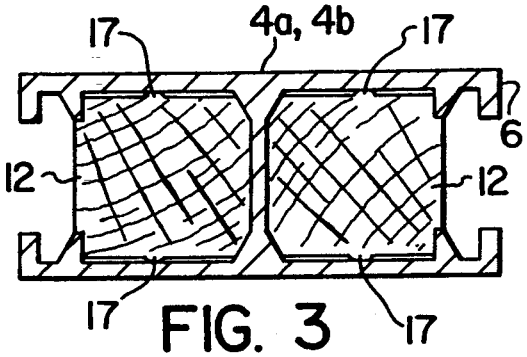
FIG. 3 illustrates an end section view of a first embodiment of an extruded aluminum beam with wood nailer strips in the interior cavities.
Figure 4:
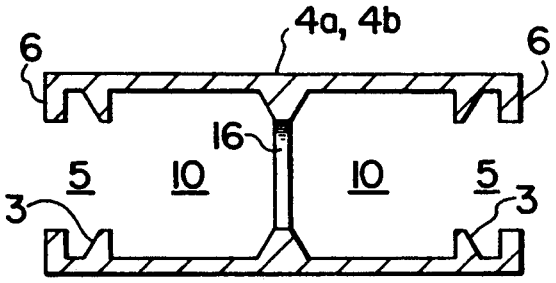
FIG. 4 illustrates an end section view of a first embodiment of an extruded aluminum beam with tie slot formed in the interior membrane.
Figure 5:
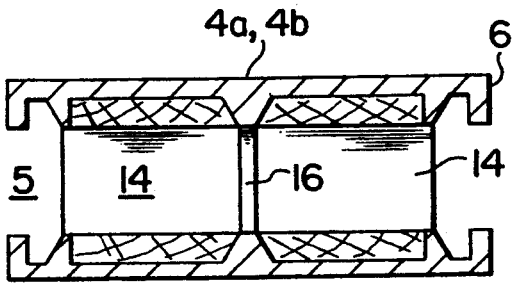
FIG. 5 illustrates an end section view taken along section 5—5 of FIG. 1 of a first embodiment of an extruded aluminum beam with tie slot formed in the interior membrane and the two wood nailer strips.

FIG. 1 illustrates an isometric view of a waler, strongback, wall formwork combination according to the invention, used to construct a concrete form system. FIG. 2 illustrates an end section view of a first embodiment of an extruded aluminum beam. FIG. 3 illustrates an end section view of a first embodiment of an extruded aluminum beam with wood nailer strips in the interior cavities. FIG. 4 illustrates an end section view of a first embodiment of an extruded aluminum beam with tie slot formed in the interior membrane. FIG. 5 illustrates an end section view taken along section 5—5 of FIG. 1 of a first embodiment of an extruded aluminum beam with tie slot formed in the interior membrane and the two wood nailer strips.

The first embodiment aluminum beam **4*a* or 4*b* as illustrated in FIGS. 1 through 5 is balanced, that is, it is reversible and has equal strength in any direction. Thus, installers do not need to concern themselves with ensuring that the beam 4*a* or 4*b* is right-side in or out, or up or down. As seen in FIG. 1, three horizontal waler beams 4*a* are secured to and support a plywood concrete retaining wall 2. The walers 4*a* are reinforced and supported by a series of vertical strongbacks, one of which is shown as 4*b* in FIG. 1, the middle waler 4*a* is secured to the vertical strongback 4*b* by a T-bolt 19. Wood nailer strips 12 are optional and may be positioned in the cavities of the beams 4*a*. The plywood wall formwork 2 is nailed to the nailer strips in conventional manner. A matching "mirror" form constructed in the same manner as the waler 4*a*, strongback 4*b*, wall 2, is constructed to provide a space for poured concrete between the two walls 2. The two forms are secured together in spaced relationship by conventional form-ties, one of which is shown as 8 in FIG. 1. The form-tie 8 extends through slot 14 in nailer strip 12. The end of the form-tie 8 is secured in place against waler 42** by conventional or modified form clamps, (not shown).

FIG. 3 illustrates the two nailer strips 12 with a pair of respective compression ridges 17 on each side. These ridges are designed to provide an adequate friction fit of the kiln dried nailer strip 12 in the cavity 10 upon installation. These ridges 12 then compress as the nailer strip 12 absorbs moisture on the construction site and expands within the nailer strip cavity 10. As the nailer strips 12 require replacement from time to time, the nailer strips 12 are allowed to dry out and shrink to permit ease of removal.

Figure 6:
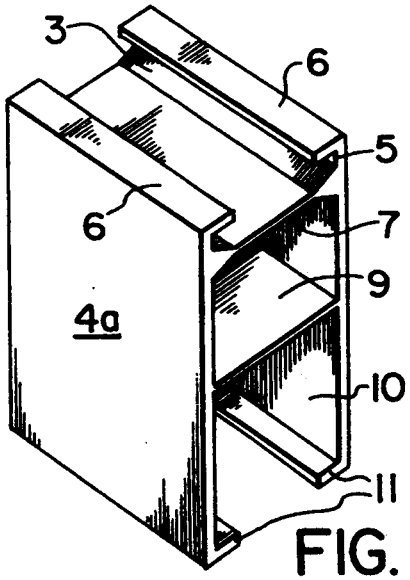
FIG. 6 illustrates an isometric view of a portion of a second embodiment of a T-bolt channel form.

FIG. 6 illustrates an isometric view of a portion of a second embodiment of T-bolt channel form beam **4*a*. As seen in FIG. 6, and similar to the design shown in FIGS. 1 to 5, a pair of T-bolt track cavity lips 6 face one another across the top elongated T-bolt track cavity 5 of the channel form 2. In contrast to the balanced design illustrated in FIGS. 1 to 5, a pair of nailer cavity lips 11 face one another at opposite sides of the base of the beam 4*a* to form a nailer strip cavity 10. An optional membrane 7 is included between opposing lips 6 and cavity 10. As seen in FIG. 6, the channel form beam 4*a* has not yet been stamped or machined to form slot 16 in the mid-cavity membrane 9 and slot 18 in the T-bolt cavity membrane 7**.

Figure 7:
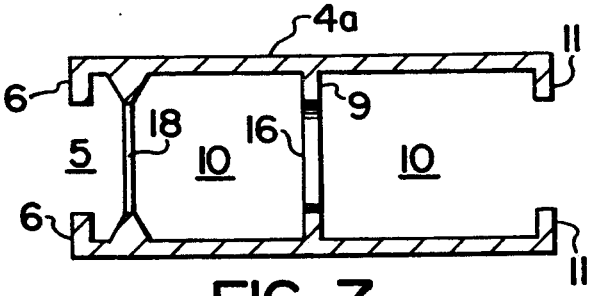
FIG. 7 illustrates an end view of a second embodiment of a T-bolt channel form.

FIG. 7 illustrates an end view of the second embodiment of the T-bolt channel form beam. As seen in FIG. 7, in end view, a slot 16 has been stamped or machined in nailer strip cavity membrane 9. Likewise, a slot 18 has been stamped or machined in T-bolt cavity membrane 7.

In both the first embodiment and the second embodiment, the pair of T-bolt track cavity lips 6 face one another at right angles. The pair of angle faces 3, which are formed on either side of the T-bolt track cavity 5 are typically formed at a 60° angle with the sides. The function of the pair of angle faces 3 to engage the T-bolt 19 will be explained in greater detail below. The T-bolt channel form beam **4*a*, when constructed of extruded aluminum, is designed so that one or two wood nailer strips 12 (see FIGS. 3 and 5) can be easily inserted in one or both nailer strip cavities 10 from the end of the beam. The facing T-bolt cavity lips 6 and the nailer cavity lips 11 of the second embodiment restrain the wood nailer strip 12** in place.

Figure 8:
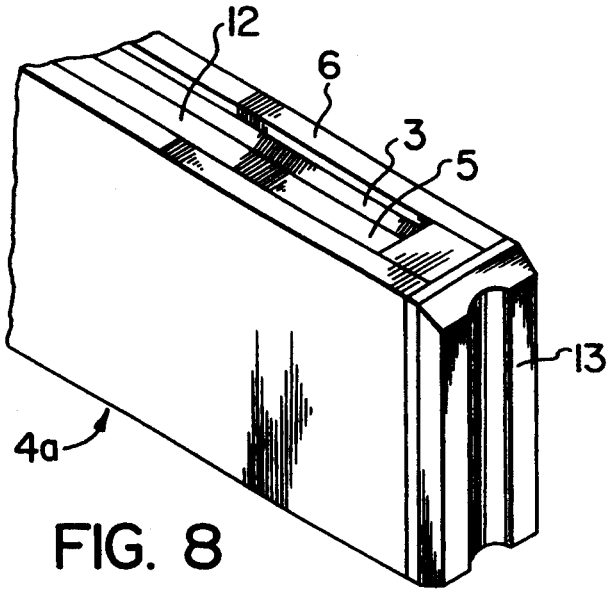
FIG. 8 illustrates an isometric view of the T-bolt channel form with end cap.

FIG. 8 illustrates an isometric view of the novel T-bolt channel beam 4*a* with end cap 13. Specifically, FIG. 8 illustrates the T-bolt channel beam 4*a*, with a T-bolt track cavity 5 formed in the top thereof, and a removable end cap 13, fitted in the end of the T-bolt channel beam 4*a*. One of the angle faces 3, formed in the interior of the T-bolt cavity 5, as well as a portion of nailer strip 12, and pair of T-bolt track cavity lips 6, are also illustrated in FIG. 1. Construction of these aspects of the T-bolt channel beam 4*a* will be discussed in greater detail below.

Figure 9:
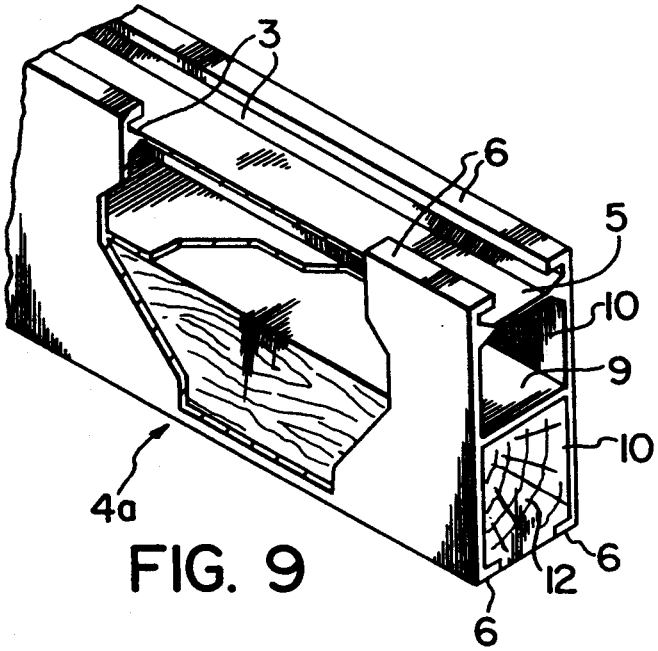
FIG. 9 illustrates an isometric cut-away view of a second embodiment of the T-bolt channel form, with a wood nailer strip installed in the interior of the channel.

FIG. 9 illustrates an isometric cut-away view of the second embodiment of the T-bolt channel beam 4*a*, with a wood nailer strip 12 installed in cavity 10 in the interior of the channel beam 4*a*. As seen in the cut-away portion of the T-bolt channel beam 4*a*, and at the end thereof, the T-bolt track cavity 5 is constructed in a channel-like fashion and has an optional T-bolt cavity membrane 7 at the bottom thereof, a pair of facing T-bolt track cavity lips 6, formed at the top sides thereof, and a pair of angle faces 3 formed between the membrane 7 and the sides of the T-bolt cavity 5. A first mid-cavity 10, which is separate from cavity 5 and has an elongated hollow configuration, is formed in the interior of the T-bolt channel beam 4*a*. This cavity 10 can receive a nailer strip 12 (not shown). Also, a nailer strip cavity 10 is formed in the bottom portion of the T-bolt channel beam 4*a*. Nailer strip cavity 10, however, is specifically formed to receive a wood nailer strip 12. This nailer strip 12 is used when erecting a concrete formwork system as shown in FIG. 1. Plywood sheets, or the like, are nailed to the nailer strip 12, through the space provided between the two facing nailer cavity strip lips 11, which are shown as an opposing pair at the bottom end of the T-bolt channel beam 4*a*.

Figure 10:
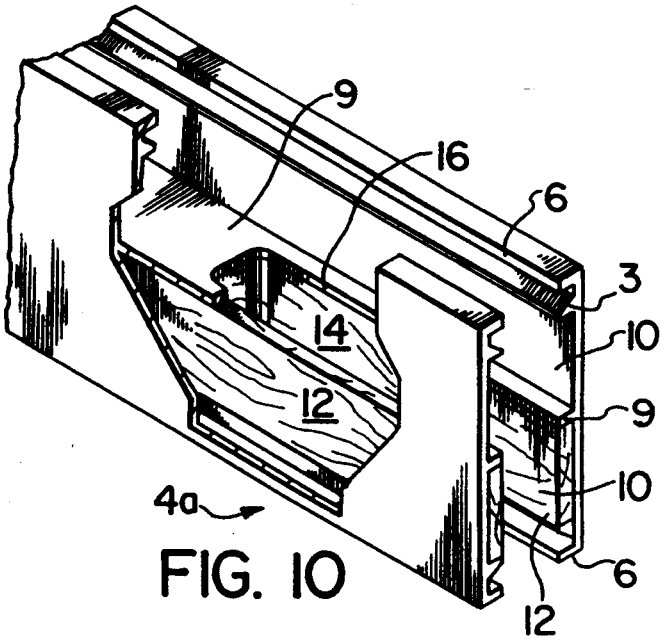
FIG. 10 illustrates an isometric cut-away view of a first embodiment of the T-bolt channel form with snap-tie receiving slots cut through the internal membrane and the nailer strip of the T-bolt channel form.

FIG. 10 illustrates an isometric cut-away view of the first embodiment of the T-bolt channel form beam 4*a* with form-tie receiving slots 14 and 16 cut through the internal mid-cavity membrane 9 and the nailer strip 12 of the T-bolt channel form beam 4*a*. FIG. 10 is different from FIG. 9 because it shows the "balanced" first embodiment channel form 4*a* with T-bolt cavities and lips 6 at opposite ends. As seen in FIG. 10, an elongated vertical slot 14 has been cut or drilled vertically through nailer strip 12. The slot 14, which has been cut through wood nailer strip 12, aligns with slot 16, which has been formed through mid-cavity membrane 9. In the second embodiment shown in FIG. 9, the slot 18, which has been formed through T-bolt cavity membrane 7, also aligns. The elongated slots 14, 16 (and 18 in the second embodiment) can be formed to have virtually any length. However, they should align with one another at all points. These slots 14, 16 (and 18) are used for receiving standard form-ties 8 and form clamps used in conventional formwork construction, as seen in FIG. 1. Accordingly, the T-bolt channel form beam 4*a*, 4*b* can be used in place of ordinary 2×4's, and the like, in standard concrete form construction systems. The T-bolt channel form beam 4*a*, 4*b* has the advantage that it is much stronger and straighter and dimensionally consistent, and reusable than a standard wood 2×4. In many instances, it can be used in place of aluminum I beams. Also, the beams 4*a* and 4*b* are long lasting, and can be reused many times. If need be, after the concrete has been poured, the beams 4*a* and 4*b*, can be disassembled and used to build temporary buildings and shelters on the construction site, or put to a number of other uses.

The slots 14 and 16 (and 18) have a strong advantage over conventional systems because the T-bolt 19 can be placed at virtually any point along the length of the channel form 4*a*, 4*b*. In other words, T-bolt positions do not necessarily have to be aligned horizontally or vertically as is the case with conventional concrete formwork systems. This provides considerable versatility not now possible with existing systems. Furthermore, because of the slots 14 and 16, a vertical strongback 4*b* can be placed anywhere along a slot 14, 16, and is not restricted to the location of a snap-tie 8. An advantage of the T-bolt 19 is that the carpenter or installer can place the T-bolt 19 at any location. Conventional form-ties, on the other hand, are usually aligned vertically, which means that the strongbacks must be place at specific points corresponding with the form-ties. Furthermore, the one or more nailer strips 12 can be of any practical length, although typically 4 or 8 ft. (1.3 to 2.6 m) lengths would be suitable. The aluminum T-bolt channel form beam extrusion 4*a*, 4*b* would be typically 4, 8 or 12 ft. in length.

Another advantage of the T-bolt channel form beam system according to the invention is that the joints of horizontal walers 4*a* need not be vertically aligned. In other words, the joints of one row of horizontal walers can be placed at given points, and the joints of adjacent above or below horizontal walers can be offset so that they do not align with the joints of the adjacent upper and lower walers. This is advantageous because not only can the vertical strongbacks 4*b* be placed at any location, by using T-bolts according to the invention, but also the joints of adjacent walers by being non-aligned provide a self-straightening action when the T-bolts 19 are tightened against the strongbacks 4*a*. A problem that occurs when the joints of walers of conventional systems align vertically is that the structure is weak at such locations and a "bulge" can develop in the formwork due to the hydrostatic head of concrete when it is poured into place in the cavity in the form.

Figure 11:
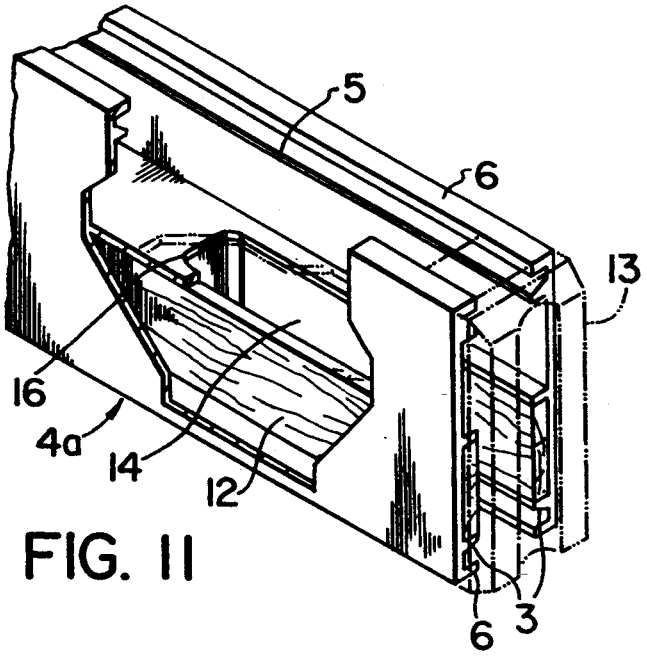
FIG. 11 illustrates an isometric partially cut-away view of the isometric figures of FIGS. 8 and 10 overlaid upon one another.

FIG. 11 illustrates a partially cut-away view of the isometric figures of FIGS. 8 and 10 overlaid upon one another. FIG. 11 illustrates in overlay pattern how the T-bolt channel form beam 4*a*, the end cap 13 and nailer strip 12 and slots 14 and 16 interact to form an assembled system according to the invention. FIG. 1 also illustrates the assembled system.

Figure 12:
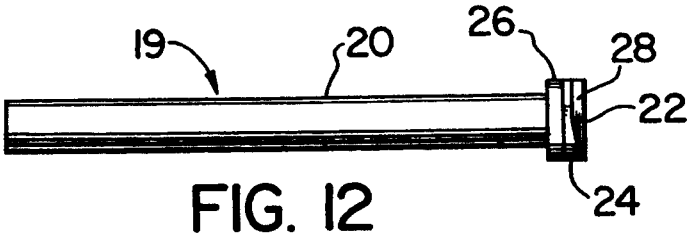
FIG. 12 illustrates a side view of a T-bolt according to the invention, in insert position.

FIG. 12 illustrates a side view of a T-bolt 19 according to the invention, when in insert position. As seen in FIG. 12, the T-bolt 19 consists of a long cylindrical stem 20, which has formed at one end thereof a T-bolt head 22. The head 22 has a position flange 24, and an angle face abutment flange surface 28 formed therein, as will be explained in detail below. A circular T-bolt cavity lip engaging ring shoulder 26 is formed between the flange 24 and the stem 20.

Figure 13A:
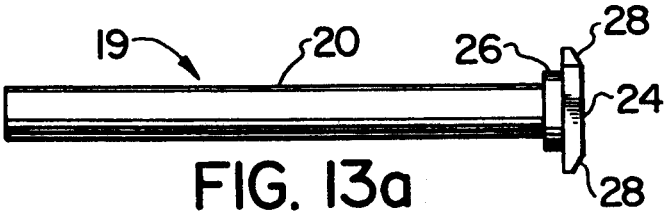
FIG. 13*a* illustrates a side view of a T-bolt rotated 90° to a lock position.
Figure 13B:
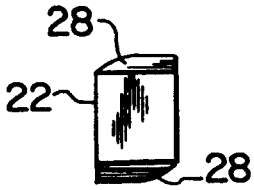
FIG. 13*b* illustrates a right end view of the T-bolt illustrated in FIG. 13*a*.
Figure 13C:
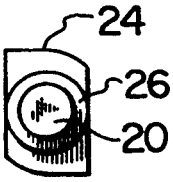
FIG. 13*c* illustrates a left end view of the T-bolt illustrated in FIG. 13*a*.

FIG. 13*a* illustrates a side view of a T-bolt 19 rotated 90° to a lock position. FIG. 13*b* illustrates a right end view of the T-bolt illustrated in FIG. 13*a*. FIG. 13*c* illustrates a left end view of the T-bolt illustrated in FIG. 13*a*. As seen in FIG. 13*a*, the T-bolt 19 is shown in locked position, that is, rotated 90° compared to the view in FIG. 12. In this locked position, the opposed pair of angle face abutment flange faces 28 are oriented vertically upwardly and downwardly. FIG. 13*b* clearly shows the "head" end of the T-bolt 19. The head 22 is formed to have a generally rectangular configuration.

The pair of opposing angle face abutment flange faces 28 are curved at respective opposite ends, and have an angle which corresponds closely with the angle of the respective pairs of angle faces 3 formed in the T-bolt cavity of the channel form beam 4*a*, as explained previously. FIG. 13*c* illustrates a "stem end" view of the T-bolt 19. The circular T-bolt cavity lip engaging ring face 26 is sized so that it fits closely within, but is slightly less in dimension than the space which is formed between opposing T-bolt track cavity lips 6 of channel form beam 4*a*. Position flange 24 is curved at two of the opposing corners. These curves facilitate insertion of the T-bolt 19 into the T-bolt track cavity 5, when the T-bolt is in insert position, and rotation 90° into locked position. It will be noted that the T-bolt can only be rotated in one direction into locked position. Thus, when locked, it is not possible to unlock the T-bolt unless the T-bolt is reverse rotated in the same manner.

Figure 14:
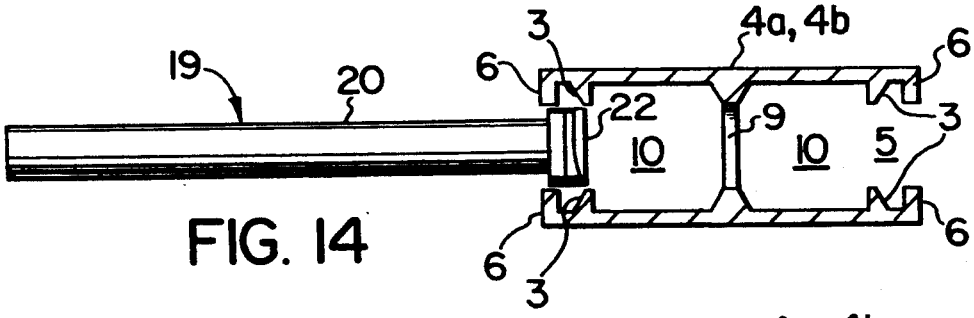
FIG. 14 illustrates a side view of a T-bolt inserted into a T-bolt receiving cavity of a first embodiment of the channel form.

FIG. 14 illustrates a side view of a T-bolt 19 inserted into a T-bolt receiving cavity of a channel form beam 4*a*. In the insert position, the ring shoulder 26 fits closely with the pair of opposing cavity lips 6. The position flange 24 is in alignment with the widest portion of the T-bolt track cavity 5 (see FIG. 2). As seen in FIG. 14, no wood nailer strip 12 has been inserted into nailer strip cavity 10. However, it will be understood that this can be the case, as shown in FIGS. 1, 3, 4 and 10.

Figure 15:
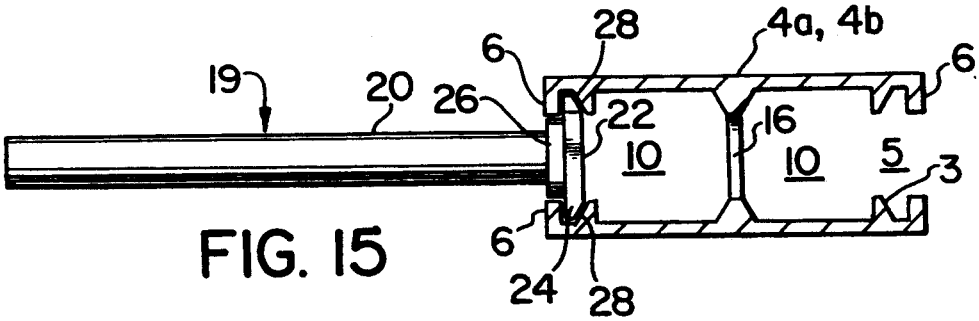
FIG. 15 illustrates a side view of a T-bolt inserted in and turned 90° to a lock position in a T-bolt cavity of a first embodiment of the channel form.

FIG. 15 illustrates a side view of a T-bolt 19 inserted and rotated to a lock position in the T-bolt cavity of a channel beam 4*a*. FIG. 15 specifically illustrates how the T-bolt 19, when rotated 90° to a locked position, causes the ends of the flange 24 to rotate into the sides of the T-bolt track cavity 5, between lips 6 and angle faces 3, and the angle face abutment flange faces 28 move into position relative to the corresponding pair of angle faces 3 of the channel form beam 4*a*. In this position, the T-bolt 19 is securely locked in position in the interior of T-bolt cavity 5. The angled faces 28, and the rounded corner configuration thereof, as illustrated in FIGS. 13*b* and 13*c*, enable the T-bolt 19 to be readily rotated 90°. However, it is not possible to rotate the T-bolt 19 beyond the 90° position. If this were the case, then the T-bolt could be rotated 180°, for example, which would then place it in an unlocked position (which is used for inserting the T-bolt 19 into the cavity 5) and the T-bolt 19 could separate from the beam 4*a* and the form could accidentally be pulled apart, which might be hazardous.

Figure 16:
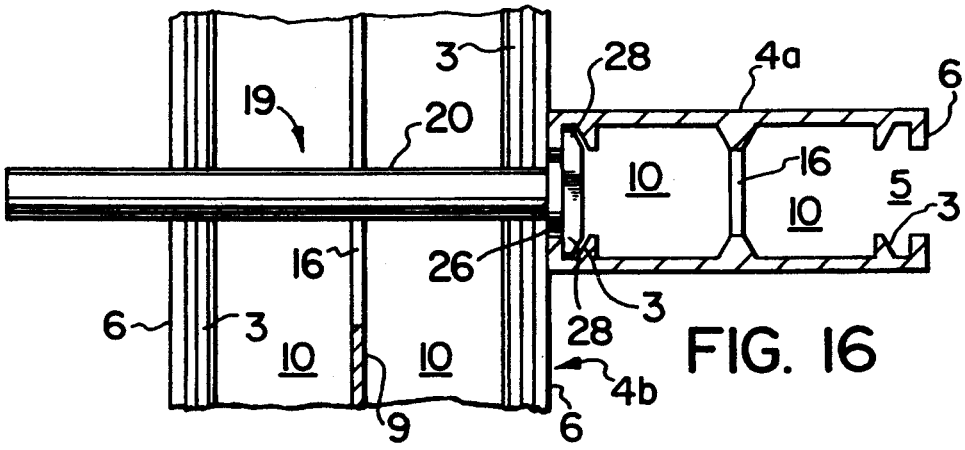
FIG. 16 illustrates a side view of a T-bolt inserted in a lock position in a T-bolt cavity of a first embodiment of channel form beam used as a waler, the stem of the T-bolt penetrating through a corresponding right angle first embodiment channel form used as a strongback.

FIG. 16 illustrates a side view of a T-bolt 19 inserted in a lock position in a T-bolt cavity of a channel form beam system used as a waler 4*a*, the stem of the T-bolt 20 penetrating through a corresponding channel form beam 4*b* used as a strongback. FIG. 1 can also be referred to for illustration. FIG. 16 specifically illustrates how the channel form beam 4*a*, shown in end section view, acts as a waler, while the channel form beam 4*b*, illustrated in side section view at the left, acts as a vertical strongback. The stem 20 of the T-bolt 19 passes through the vertical channel form beam 4*b*, which acts as a strongback, and is conventionally threaded at its free end so that a construction worker can thread a bolt (see FIG. 1) on the end in order to secure all components snugly together. FIG. 16 is also helpful in illustrating how the slot 16, which is typically six inches long, is positioned to receive at virtually any position a form-tie 8, which extends through the concrete form from the right (the concrete form is not shown in FIG. 16, but see FIG. 1). Similarly, the elevation of the T-bolt 19 can be placed at any position along the vertical lengths of the respective slot 16 of the channel form beam 4*b* which is acting in FIG. 16 as a strongback. FIG. 16 also demonstrates how it is necessary only to have conventional short end-ties 8 on the construction site. In conventional concrete form systems, short end-ties are adapted to penetrate only through the horizontal channel form beam 4*a*, or 2×4, acting as a waler. Long end-ties, on the other hand, penetrate through both the waler and the strongback on each side of the form. In the invention, long end-ties are not necessary because the T-bolt 19 serves to hold everything together, and effectively replaces the long end-ties. It is therefore necessary to have only short end-ties on the construction site.

Figure 17:
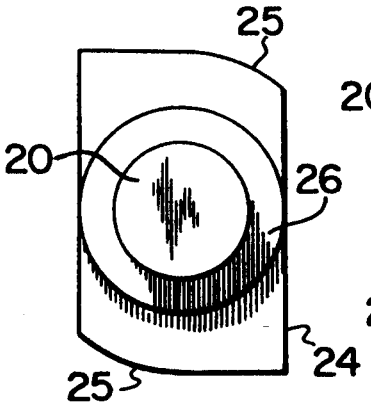
FIG. 17 illustrates an enlarged end view of the head construction of a T-bolt.
Figure 18:
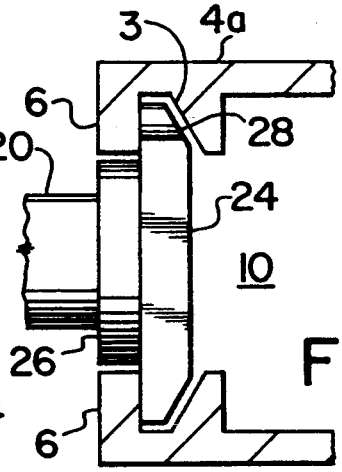
FIG. 18 illustrates an enlarged side view of a T-bolt in a locked position in a T-bolt receiving cavity of a first embodiment channel form.

FIG. 17 illustrates an enlarged end view of the head construction of a T-bolt. FIG. 18 illustrates an enlarged side view of a T-bolt in a locked position in a T-bolt receiving cavity of a channel form beam 4*a*. The pair of rounded opposing corners 25 enable the T-bolt 19 to be rotated 90° in only one direction, from an insert position to a locked position. The corresponding intervening right angle corners prevent rotation of the T-bolt in the opposite direction, and hence unlocking of the T-bolt. When the T-bolt has been tightened by pulling stem 20 to the left, such as occurs when a tightening action is placed on a nut 15 (see FIG. 1), the abutting faces of the flange 24 are snugly and centrally secured against the underlying interior faces of the pair of T-bolt track cavity lips 6.

Figure 19:
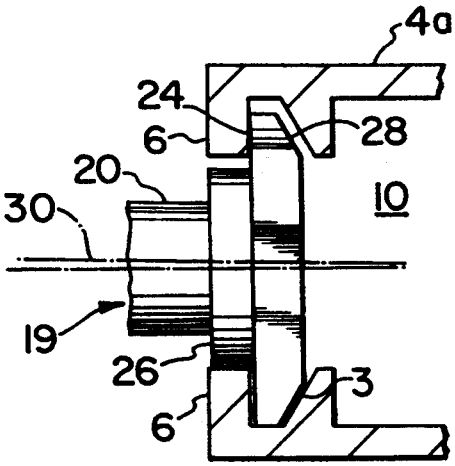
FIG. 19 illustrates an enlarged side view of a T-bolt in locked position and a T-bolt receiving cavity of a first embodiment channel form system in a first untightened position.
Figure 20:
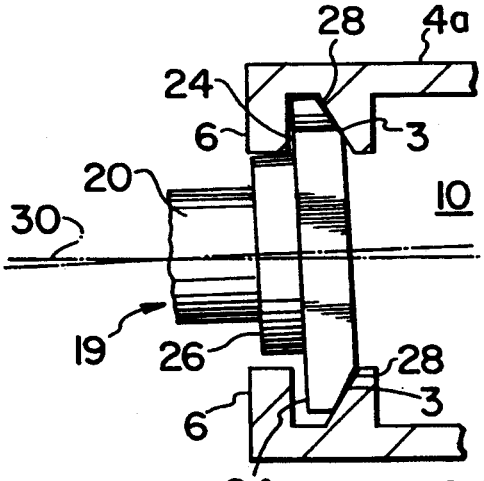
FIG. 20 illustrates an enlarged side view of a T-bolt in locked position and a T-bolt receiving cavity of a first embodiment channel form beam in a second untightened position.

FIG. 19 illustrates an enlarged side view of a T-bolt 19 in locked position in a T-bolt receiving cavity of a channel form beam 4*a* in a first untightened position. FIG. 20 illustrates an enlarged side view of a T-bolt in locked position in a T-bolt receiving cavity of a channel form beam 4*a* system in a second untightened position. It will be recognized that in untightened configuration, and with the small amount of "play" that is possible between the flange 24 and T-bolt cavity 5, the T-bolt 19 can take up any one of a number of different positions in the interior of the T-bolt track cavity 5. As seen in FIG. 19, however, even if the T-bolt 19 is at its bottom-most position, which is the situation when the two contact points indicated by the two bottom arrows occur, the top of flange 24 still abuts the interior face of lip 6, as illustrated by the upper arrow. FIG. 20, on the other hand, illustrates the topmost position that the T-bolt 19 can take. Even in this position, the upper and lower ends of flange 24 remain within the interior faces of the pair of matching lips 6. Thus it is not possible for the T-bolt 19 to pull free, or fail to secure the lips 6 in any position.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A T-bolt channel beam comprising:

(a) an elongated hollow channel member;

(b) an elongated T-bolt receiving first cavity formed in a top region of the channel member, said elongated cavity having therein a first elongated opening which is parallel with the elongated channel member and exposes the interior of the first elongated cavity to the exterior, said first cavity having a pair of opposing lips facing one another and constructed along respective sides of the elongated first opening exposing the interior of the first cavity;

(c) an elongated second cavity formed in the interior of the elongated channel member, adjacent to and parallel with the elongated first cavity and communicating by a second opening with the first cavity;

(d) an elongated third cavity, formed in the interior of the elongated channel member, adjacent to and parallel with the second cavity and first cavity, and separated in part from the second cavity by an elongated membrane and communicating by a third opening with the second cavity; and (e) an elongated T-bolt receiving fourth cavity, inverted and symmetrical in orientation with the first cavity, and adjacent to and parallel with the third cavity, communicating by a fourth opening with the third cavity and the fourth cavity having therein an elongated fifth opening which is parallel with the elongated channel member and exposes the interior of the fourth elongated cavity to the exterior, said fourth cavity having a pair of opposing lips facing one another and constructed along respective sides of tee elongated fifth opening exposing the interior of the fourth cavity.

2. A channel beam as claimed in claim 1 wherein the channel beam has a symmetrical and generally rectangular exterior configuration about the membrane separating the second and third cavities.

3. A channel beam as claimed in claim 1 wherein an elongated slot is formed in the membrane separating the second cavity from the third cavity.

4. A channel beam as claimed in claim 2 wherein the walls of the beam between the first and second cavity, and the walls of the beam between the third cavity and the fourth cavity have angled face ridges which are elongated and parallel with the elongated cavities.

5. A channel beam as claimed in claim 4 wherein the elongated first and fifth openings are on opposite sides, extend the length of the channel beam and are constructed along respective sides of the elongated openings exposing the interiors of the first and fourth cavities.

6. A channel beam as claimed in claim 1 wherein the first cavity or the fourth cavity holds therein a T-bolt which comprises:

(a) an elongated cylindrical stem;

(b) a head having a generally rectangular flange configuration, with opposed two of the four corners of the rectangle being rounded; and (c) a ring shoulder constructed between the head and the stem, the ring shoulder being adapted to fit between the elongated first or fifth opening in the first cavity or the fourth cavity of the channel beam.

7. A channel beam as claimed in claim 6 wherein the T-bolt head includes angled faces which abut with angled faces of the first cavity or the fourth cavity of the channel beam when the T-bolt is rotated 90° so that the ends of the rectangular flange penetrate laterally under the opposing lips and lock into the interior or the first cavity of the fourth cavity of the channel beam.

8. A channel beam as claimed in claim 7, designated as a first channel beam and including a second channel beam which is fitted together with the first channel beam, with the first channel beam and the second channel beam at right angles with one another, the head of the T-bolt being positioned in a locked position in the first cavity of the first channel beam, the stem of the T-bolt extending through an opening in the elongated membrane between the second and third cavities of the second channel beam, the end of the stem of the T-bolt protruding from the second channel beam and being adapted to be fixed into position.

9. A T-bolt channel beam comprising:

(a) an elongated channel member;

(b) an elongated top first cavity formed in the top region of the elongated channel member, said elongated cavity having therein an elongated first opening which is parallel with the elongated channel member and exposes the interior of the first cavity to the exterior, the top of the first cavity having a pair of opposing lips facing one another and constructed along respective sides of the elongated first opening exposing the interior of the first cavity to the exterior;

(c) an elongated second middle cavity formed in the interior of the elongated channel member, parallel and adjacent with the elongated top first cavity, said second cavity including a first membrane separating the top first cavity from the middle second cavity;

(d) an elongated third bottom cavity formed in a bottom region of the channel member, parallel with and adjacent to the second middle cavity, and separated from the second cavity by an elongated second membrane, said third bottom cavity having an elongated second opening formed therein which exposes the interior of the third cavity to the exterior, said elongated second opening being positioned on the side of the third cavity opposite the second membrane separating the second cavity from the third cavity, said third bottom cavity having a pair of opposing lips facing one another and constructed along respective sides of the elongated second opening exposing the interior of the third cavity to the exterior;

(e) an elongated third opening formed in the first membrane separating the first cavity from the second cavity; and (f) an elongated fourth opening formed in the second membrane separating the second cavity from the third cavity.

10. A channel form beam as claimed in claim 9 wherein the first membrane has angled faces at each elongated side thereof mating with respective sides of the first cavity.

11. A channel form beam as claimed in claim 9 wherein the first cavity holds therein a T-bolt which comprises:

(a) an elongated cylindrical stem;

(b) a head having a generally rectangular flange configuration, with opposed two of the four corners of the rectangle being rounded; and (c) a ring face constructed between the head and the stem, the ring face being adapted to fit between opposing facing lips of the top first cavity of the channel beam.

12. A channel form beam as claimed in claim 11 wherein the T-bolt head includes angled faces which abut with angled faces of the first cavity of the channel beam when the-T-bolt is rotated 90° so that the ends of the rectangular flanges penetrate laterally into the interior of the first top cavity and under the opposing lips of the channel beam.

13. A channel form beam as claimed in claim 12, designated as a first channel beam and including a second channel beam fitted together with the first channel beam, with the first channel beam and the second channel beam at right angles with one another, the head of the T-bolt being positioned in a locked position in the first cavity of the first channel beam, the stem of the T-bolt extending through a slot in the membrane of the second channel beam, the end of the stem protruding from the second channel beam, opposite the first channel beam and being adapted to be fixed into position.

14. A channel beam as claimed in claim 9 wherein the exterior the channel beam as a generally rectangular configuration.

15. A channel beam as claimed in claim 14 wherein the top first cavity, the middle second cavity, and the third bottom cavity have generally square or rectangular cross-section configurations, and the first membrane and the second membrane are generally planar and are parallel to one another.

16. A channel beam as claimed in claim 8 including a tie rod extending through the interior of the first channel beam or the second channel beam.

17. A channel beam as claimed in claim 13 including a tie rod extending through tee interior of the first channel beam or the second channel beam.

* * * * *